United States Patent [19]

Barker et al.

[11] 4,003,152

[45] Jan. 18, 1977

[54] SAFETY SYSTEM

[75] Inventors: James N. Barker, Ontario; Edward A. Cartwright, Montclair, both of Calif.

[73] Assignee: Precision Thin Film Corporation, Los Angeles, Calif.

[22] Filed: Oct. 7, 1975

[21] Appl. No.: 620,357

Related U.S. Application Data

[60] Division of Ser. No. 451,975, March 18, 1974, Pat. No. 3,939,679, and a continuation-in-part of Ser. No. 371,378, June 19, 1973, abandoned.

[52] U.S. Cl. ..... 42/70 R

[51] Int. Cl.[2] ..... F41C 17/00

[58] Field of Search ..... 42/70 R, 84, 1 R, 1 LP; 317/9 R; 340/248 R, 274 R; 70/277, DIG. 11, 46, 51

[56] References Cited

UNITED STATES PATENTS

| | | | |
|---|---|---|---|
| 1,076,530 | 10/1913 | Tepins | 42/84 |
| 3,400,393 | 9/1968 | Ash | 42/84 |
| 3,553,877 | 1/1971 | Welch et al. | 42/70 R |
| 3,673,725 | 7/1972 | Cravener | 42/70 R |
| 3,725,939 | 4/1973 | Saltzstein | 70/277 |

*Primary Examiner*—Charles T. Jordan
*Attorney, Agent, or Firm*—Henry M. Bissell

[57] ABSTRACT

Normally disabled electrical and mechanical devices are caused to be enabled to operate by remote control signals having predetermined distinctive characteristics, such signals originating from enabling control equipment transported by an authorized person or persons. Receiving equipment providing output enabling signals only in response to received signals having the predetermined distinctive characteristics is preferably made integral with the mechanical or electrical devices involved and is coupled through appropriate electronic or electro-mechanical devices to the disabling means in the mechanical or electrical devices to be enabled.

23 Claims, 13 Drawing Figures

SAFETY SYSTEM

CROSS-REFERENCE TO RELATED APPLICATION OF THE INVENTION

This application is a division of co-pending application Ser. No. 451,975 of James N. Barker et al. for SAFETY SYSTEM, filed Mar. 18, 1974, now U.S. Pat. No. 3,939,679, as a continuation-in-part of co-pending application for U.S. Pat. Ser. No. 371,378, filed June 19, 1973, entitled "Safety Device for Firearm" now abandoned.

BACKGROUND OF THE INVENTION

1. Field of the Invention

This invention relates to safety systems and, more particularly to safety systems controlled by remote control signals with distinctive characteristics.

2. Description of the Prior Art

The subjects of safety and security have received widespread attention in recent years. While the two fields are inter-related there is no doubt that security has been of primary interest. The reason for the emphasis on security has been the continuous rise in crime which the yearly statistics reflect and the general feeling of private citizens in this and many other countries that lawlessness prevails. Unauthorized breaking and entering of private homes and businesses, car thefts, pleasure boat thefts, tampering with railroad switches and seizing of peace officers' weapons for use against those officers are daily occurrences. There have even been cases of attempted theft of diesel freight engines'.

The need for modernized safety and security devices and systems is apparent. Various electronic devices, such as electronic key and lock combinations, have been proposed but they have been complex, required considerable power for operation because they were called upon to do the actual mechanical work involved in, for example, moving a bolt or latch, and they were not adequately secure. They were also very expensive and bulky. They have had conspicuously little commercial acceptance.

Examples of patents which relate to the problems detailed above particularly as applicable to firearm safety systems are U.S. Pat. Nos. 2,979,845, 1,076,530, 3,400,393, 2,472,136 and 2,337,145. However all of these involve relatively cumbersome approaches to the problem which are not feasible in situations to which the present invention is directed.

SUMMARY OF THE INVENTION

It is a general object of this invention to provide a new and improved safety system with a high degree of freedom from unauthorized circumvention.

It is a further object of this invention to provide a safety system in which the mechanical or electrical portion of the system is enabled to operate in the presence of a distinctive signal but is disabled from operation in the absence of such signal.

It is an additional object of this invention to provide a safety system in which the enabling signal source may be conveniently transported by authorized personnel.

It is a still further object of this invention to provide a safety system in which the source of the enabling signal for the system is extremely compact, lightweight, self-contained, has low power consumption and is easily carried on the body (for example, the wrist) of authorized personnel.

The foregoing and other objects of this invention are accomplished by providing for a normally disabled electrical or mechanical device a source of remote signals having predetermined, distinctive characteristics, a receiver responsive only to signals having those distinctive characteristics to produce at its output terminals an enabling signal, and means responsive to the enabling signal to permit normal operation of the mechanical or electrical device associated with the receiver.

BRIEF DESCRIPTION OF THE DRAWING

The invention can be better understood with reference to the specification when taken in conjunction with the drawings, in which.

DESCRIPTION OF THE PREFERRED EMBODIMENTS

Figure 1:
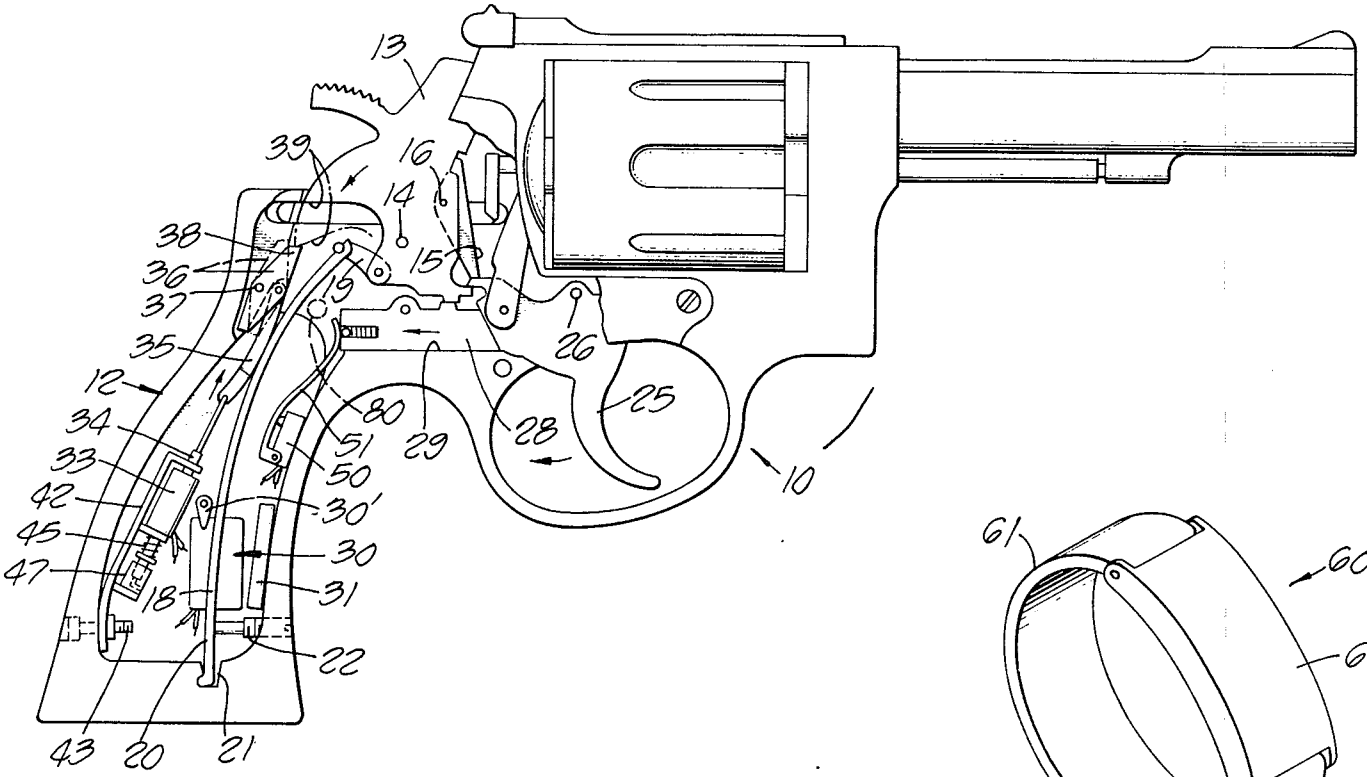
FIG. 1 is a side view, partially cut away, showing a firearm incorporating a particular receiving and enabling mechanism, according to the present invention.

Referring to FIG. 1, there is shown a typical hand-held firearm, designated generally 10, incorporating certain of the features of the present invention. The firearm there shown is a Smith and Wesson revolver of a well-known construction. No alterations of any significance are required in the gun mechanism other than two minor machining operations to facilitate mounting a lock for the firing mechanism on the frame 12 of the firearm.

As shown in FIG. 1, the right-hand stock or cover plate has been removed to expose the firing mechanism. As there shown, the parts are in their normal condition with hammer 13 closed. This hammer is supported on a pivot pin 14. Sear 15 is carried by hammer 13 and pivotally connected thereto by a pin 16. Hammer 13 is urged toward a closed position by a powerful leaf spring 18 connected to the hammer by stirrup 19 and having its lower end 20 anchored in a recess 21 of the handgrip frame. As is well-known, the lower end of spring 18 is fulcrummed against an adjustable set screw 22 extending through a threaded hole in frame 12.

Trigger 25 is pivoted to main frame 12 on a pin 26 with its inner end bearing against the lower end of sear 15. The rebound slide 28 is reciprocally supported in a slideway 29 of the main frame with its right-hand end bearing against the cam surface on the left-hand peripheral edge of trigger 25.

The subassembly provided by this invention and carried on the firearm for the purpose of providing positive assurance against its use by anyone except an authorized person comprises a radio receiver and decoder capsule 30 having an antenna 31 and a self-contained battery, not shown, which may be rechargeable, all mounted in a cavity in the left-hand cover plate of the handgrip. Capsule 30 may be releasably held in place in this cavity as by a keeper clip 30'. Details of this capsule and its antenna will be described in greater detail presently. The output signal of capsule 30 is employed to operate a solenoid 33 having an armature 34 coupled by a line 35 to a latch lever 36 pivoted to main frame 12 on a pin 37. The solid line showing a latch lever 36 is its normal position with its upper end 38 positioned in the path taken by the lower left-hand corner 39 of hammer 13 in order to discharge the firearm. When latch 36 is so positioned it is impossible for hammer 13 to be rotated further counterclockwise as is necessary for the trigger to release sear 15. However, when the latch 36 is rotated slightly counterclockwise to the dotted line position by the energized solenoid 33, the firing mechanism can be operated in the customary manner.

Solenoid 33 includes a mounting bracket 42 secured to the firearm frame in any suitable manner, as by anchor bolt 43. A light spring 45 normally urges armature 34 downwardly as viewed in FIG. 1 to hold latch 38 in the path of portion 39 of hammer 13. The lower end of armature 34 includes a dashpot 47 constructed in any suitable manner and functioning to retard the return of the armature to its normal locking position after the solenoid has been momentarily energized.

Energization of solenoid 33 is controlled, provided the receiver unit is coupled to the transmitter unit, by a normally open microswitch 50 suitably fixed to frame 12 and having an operating lever 51 normally biased firmly against the left-hand end of rebound slide 28. Preferably, the switch is so adjusted that the slightest movement of trigger 25 in a direction to discharge the firearm is sufficient to close switch 50 and energize solenoid 33 in a manner which will be described in greater detail presently, thereby disabling the firing mechanism locking latch 36.

Figure 2:
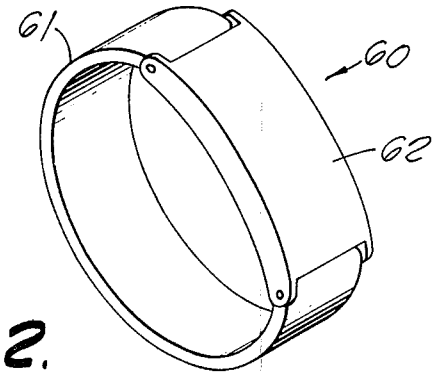
FIG. 2 is a perspective view of one embodiment of a source of remote signals having predetermined distinctive characteristics designed to operate the receiving and enabling mechanism of FIG. 1.

Referring now to FIG. 2, there is shown a suitable embodiment of the control subassembly worn by the person authorized to carry firearm 10. As there shown, subassembly 60 comprises an expandable-contractable wristband 61 secured to the opposite ends of a housing 62 enclosing a signal generator providing the control signal employed to operate the enabling solenoid 33. It will be understood that housing 62 encloses a miniature radio transmitter and a rechargable power supply for that transmitter, each appropriately designed for mounting within a casing no larger than a conventional wrist watch.

The signal generator worn on the person may take many forms but preferably provides a continuously radiated distinctive signal of a type readily distinguished from any other signal possibly present in the vicinity. Additionally and desirably a plurality of transmitters is connected in parallel, any one or more of such transmitters being adequate to provide an operating signal for the receiver 30 housed in the firearm.

Figure 5:
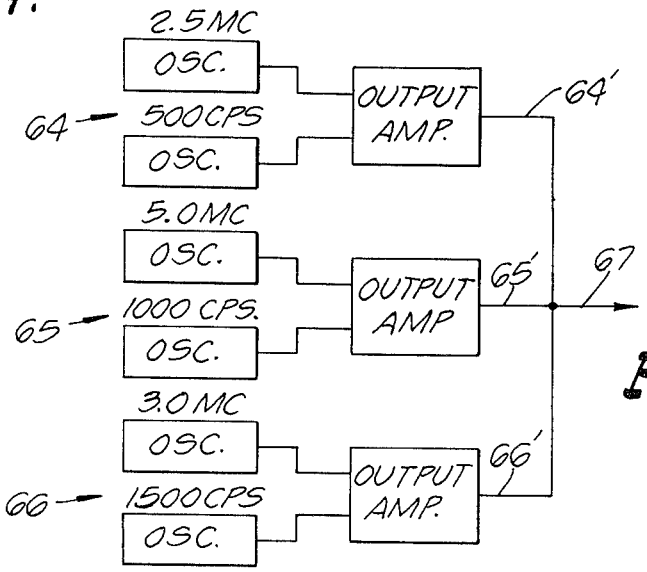
FIG. 5 is a block diagram of a radiant signal generator which may be housed in the device of FIG. 2, for example.

As shown in FIG. 5 by way of example, the transmitter includes three miniature transmitters 64, 65, 66 having their respective outputs 64', 65', 66' connected to the metal housing 62 of FIG. 2 which housing is worn in direct contact with the body and which, in combination with the body, acts as the antenna for the several transmitters.

Each transmitter includes a high frequency oscillator modulated by a relatively low frequency modulating oscillator the resulting modulated RF signal being fed to antenna 62 via an output amplifier and common conductor 67. As shown herein by way of example, transmitter 64 comprises a 2.5 MHz oscillator modulated by a 500 Hz oscillator, whereas transmitter 65 comprises a 5.0 MHz oscillator modulated by a 1000 Hz oscillator, and transmitter 66 comprises a 3.0 MHz oscillator modulated by a 1500 Hz oscillator. Each oscillator is controlled by a high-precision crystal or other frequency control means providing adequate frequency stability and the output signal of each transmitter preferably differs from the output signal of every other transmitter designed to cooperate with a different firearm equipped with the safety device of this invention. It follows that the control receiver for a particular firearm is designed and constructed to respond only to the output signals of a particular transmitter or group of transmitters.

Figure 4:
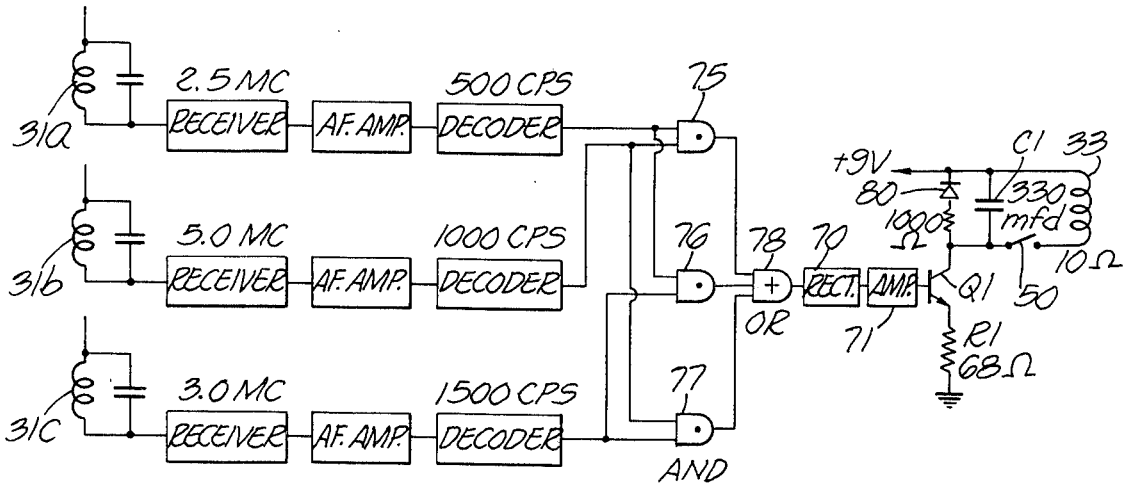
FIG. 4 is a diagram, partially in block form and partially in schematic form of the receiving, decoding and enabling circuit carried in the firearm of FIG. 1.

Referring to FIG. 4, there is shown, schematically, suitable control receiver equipment housed within capsule 30 concealed within the firearm. It will be understood there is a separate matching miniature radio receiver for each transmitter in subassembly 60. As depicted herein by way of example, the receiver subassembly includes an antenna, a receiver, an audio frequency amplifier, a signal decoder designed to provide an output only for the distinctive signal of a specific one or group of signal transmitters, any spurious signal sensed by the antenna being filtered out or rejected. The output of each signal decoder is supplied to a gating circuit connected in any suitable manner to provide an output signal to rectifier 70. An output amplifier 71 may follow rectifier 70. The gating circuit may be designed to provide an output signal if any receiver is delivering a signal or if any two receivers are delivering a signal, depending upon the type of gating employed. As shown herein by way of example, the gating circuit provides an output signal if any two of the three receivers is working properly which signal is employed to operate the disabling solenoid 33 upon pressure being applied to trigger 25 to close switch 50. Thus the gating circuit includes three AND gates 75, 76, 77 and a single OR gate 78 connected between the outputs of the several decoders and rectifier 70. As is readily apparent, any pair of properly functioning receivers suffices to operate one of the AND gates to provide an output signal for OR gate 78. That signal is rectified and amplified and supplied to the base of transistor Q1 in the energizing circuit for the disabling solenoid 33. As here shown, a 330 mfd capacitor is connected between the positive side of a 9 volt storage battery and the follower of Q1 whereas the emitter is grounded via a 68 ohm resistor R1.

Figure 3:
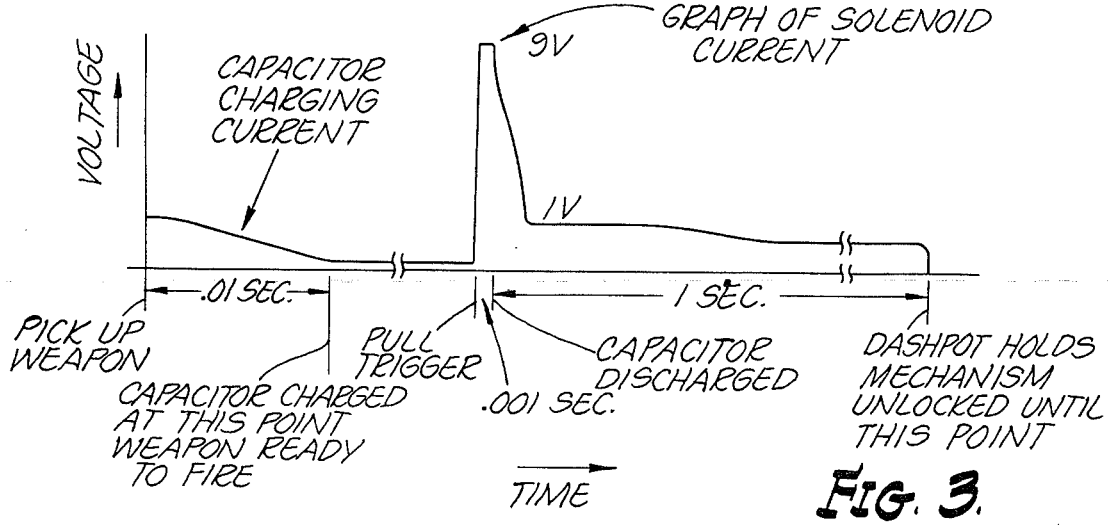
FIG. 3 is a graphical representation of the energy storage characteristics of a portion of the apparatus of FIG. 1.

The operating characteristics of the transmitter subassembly are graphically depicted in FIG. 3, it being understood that the transmitter operates continuously so long as the wrist band 60 is being worn, the power supply circuit being energized automatically as the wristband 61 contracts to press the underside casing 62 against the arm or, alternatively, as a control switch not shown but readily accessible to the wearer is pressed. Desirably, any suitable pressure actuated control switch in contact with the arm is held closed as long as the device is worn.

The output signal from each transmitter is impressed upon the body of the wearer from housing 62 and preferably is normally coupled to the receiving antennas 31*a*, 31*b*, 31*c* in sufficient strength to be processed by the associated receivers only if the person wearing the transmitter is grasping the handgrip of the firearm. Thus it will be noticed from FIG. 1 that when grasping the handgrip the fingers and palm of the hand will be in close proximity to the receiving antenna indicated at 31 in this figure. Each of the receivers then has a sufficiently strong signal input signal for processing by the individual receiver-decoder. The resulting decoded signals pass through the gates, such as gates 75 to 77, and thence to rectifier 70 and amplifier 71, the output from the amplifier being passed directly to the base of transistor Q1.

It is thus seen that there is an output signal from amplifier 71 substantially the instant that a person authorized to carry the firearm places his fingers about the handgrip. The charging time of capacitor C1 is approximately 0.01 seconds with the result that this capacitor is charged and remains in readiness for use in enabling the firing mechanism to operate in an extremely brief interval after the handgrip is grasped. The charging current flow is limited by the voltage drop across resistor R1. When trigger 25 is pressed ever so lightly it shifts rebound slide 28 to the left as viewed in FIG. 1 and operates microswitch 50 to its closed position thereby completing a discharge circuit for C1 through the disabling solenoid 33. The pulse of energy so released from C1 energizes the solenoid in approximately 0.001 seconds to shift latch 36 out of locking position or almost instantly following closing of switch 50 and very substantially faster than the time required for a fast trigger man to discharge a hand-held firearm.

Actuation of solenoid 33 occurs without interference from dashpot 47, but the latter then operates in a well-known manner to dampen or delay for a suitable time, say one second, the return of the armature by spring 45 to its normal disabled position. After this period of time, the invention components are in readiness to disable the firing mechanism so that the firearm is incapable of being fired a second time except in the foregoing manner and when held in the hand of the person equipped with a transmitter unit providing distinctive control signals to which the receiving equipment in the firearm is designed to respond. It follows from the foregoing that the firearm is incapable of being discharged except by a person wearing a specific transmitter unit.

Upon discharging the firearm the user releases trigger 25, thereby permitting switch 50 to return to its normal open position. Capacitor C1 then recharges as the voltage drop then taking place across R1 limits the current flow and the drain on the battery to a negligible amount.

An important auxiliary device preferably present on the firearm comprises an arming indicator providing a readily observed signal informing the user that the safety device is functioning properly at any time. This auxiliary is indicated at 80 in FIGS. 1 and 4 and comprises a light emitting diode connected in series with a 1000 ohm resistor across capacitor C1. As is readily apparent this indicator is energized automatically if a user equipped with the proper signal transmitter 60 grasps the handgrip. Indicator 80 is preferably mounted in a conveniently located and viewed position normally concealed by the user's thumb after he has observed the indicator when drawing the firearm for use. If the light emitting diode is energized the user is assured that the safety system is functioning properly and that capacitor C1 is charged. It will also be understood that upon releasing the handgrip, indicator 80 provides a discharge circuit for capacitor C1 which otherwise would remain charged for a substantial period of time.

Figure 6:
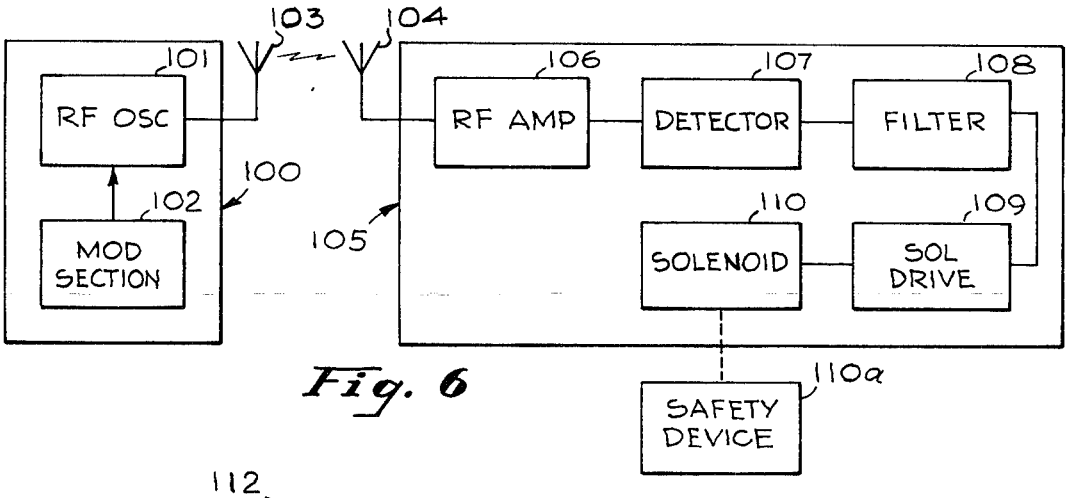
FIG. 6 is a block diagram showing the basic elements of a particular radiant energy system according to the present invention.

FIG. 6 illustrates in block form a more generalized form of a system in accordance with the invention comprising a tone-encoded transmitter 100 and receiver 105 coupled to a mechanical actuator.

In FIG. 6, transmitter 100 includes RF oscillator section 101 and modulator section 102. In its simplest form, RF oscillator section 101 includes a single signal generator operating anywhere in the radio frequency range from 1.0 MHz to as high as 10 GHz. Also in that simplest embodiment modulator section 102 may be an oscillator operating anywhere from the low audio range up to several MHz as is deemed most convenient by the designer. The modulated signal from oscillator section 101 is coupled to a simple antenna 103 which may be a metal band on the wrist of an authorized person as indicated hereinabove. The body of the person supplements the action of antenna 103 in radiating signals to the receiver portion of the safety system. The radiated signals from antenna 103 and the body of the carrier of the enabling transmitter 100 are intercepted by antenna portion 104 of the enabling receiver 105. The signal intercepted by antenna 104 is amplified at radio frequencies in RF amplifier 106, the output of which is rectified by detector 107 to yield the modulating signal from modulator section 102 in transmitter portion 100. The audio signal from detector 107 is passed through a narrow filter, such as a twin-T filter, to eliminate extraneous signals at audio frequencies. Such filtering action is performed in filter section 108. The filtered audio signal is used to trigger solenoid drive 109 which activates solenoid 110 and enables associated mechanical equipment such as the safety device 110*a* to operate whereas, prior to the activation of solenoid 110, such mechanical equipment was disabled from operation. In a more secure and more complicated embodiment transmitter portion 100 may incorporate a plurality of RF oscillators with each of which there is associated a modulator. Each of the RF oscillators may have a characteristic different from that of all of the other oscillators and each of the modulators may have characteristics which are different from those of all the other modulators so that the output from antenna 103 is a combination of signals having different carrier frequencies and different modulation characteristics. Such a transmitter section is shown in FIG. 5. Of course, with multiple RF oscillators operating at different frequencies in transmitter portion 100, receiver portion 105 must have multiple receiving channels tuned to frequencies corresponding to the frequencies of signals being radiated from antenna 103.

In general, the safety systems contemplated by this invention permit close proximity between transmitting antenna 103 and receiving antenna 104 so that the transmitted power from the RF oscillators in transmitter portion 100 may be extremely small. The result is, of course, that there is small power consumption in the transmittor portion and thus the transmitter portion may be battery-operated for long periods of time. Longlife performance may be provided by self-contained miniature batteries such as mercury cells or nickel-cadmium cells. Similarly, the power consumption of the receiver portion 105 may be kept extremely low and the receiver portion may also be battery operated. The greatest power consumption in the entire system is that utilized in activating solenoid 110. However the time of activation of solenoid 110 is usually very short so that the energy consumption is low; that is, the total watt-seconds involved in the system are very limited and longterm operation from self-contained battery supplies may be readily achieved.

It should be noted that the RF oscillator or oscillators in transmitter portion 100 may be amplitude-, frequency-, phase- or pulse-modulated. The characteristics of receiving portion 105 are adapted to accommodate the types of signals and types of modulation used in transmitter portion 100.

Means may be provided for re-charging the battery in capsule 30 of FIG. 1 while firearm 10 is in place in the holster provided for it on the authorized person. Contacts may be provided on the firearm which are insulated from the main body of firearm 10 and are connected to the terminals of the battery powering the receiving, decoding and enabling circuits in section 105 shown in FIG. 6. The holster may carry a pair of contacts adapted to cooperate with the contacts on the firearm when the firearm is in its holster, such contacts being supplied with re-charging voltage from a battery pack carried, for example, on the belt of the authorized user of the firearm or built into the holster itself. A battery condition indicator, such as is found commonly on transistorized, battery operated equipment, may be provided on firearm 10.

Figure 7:
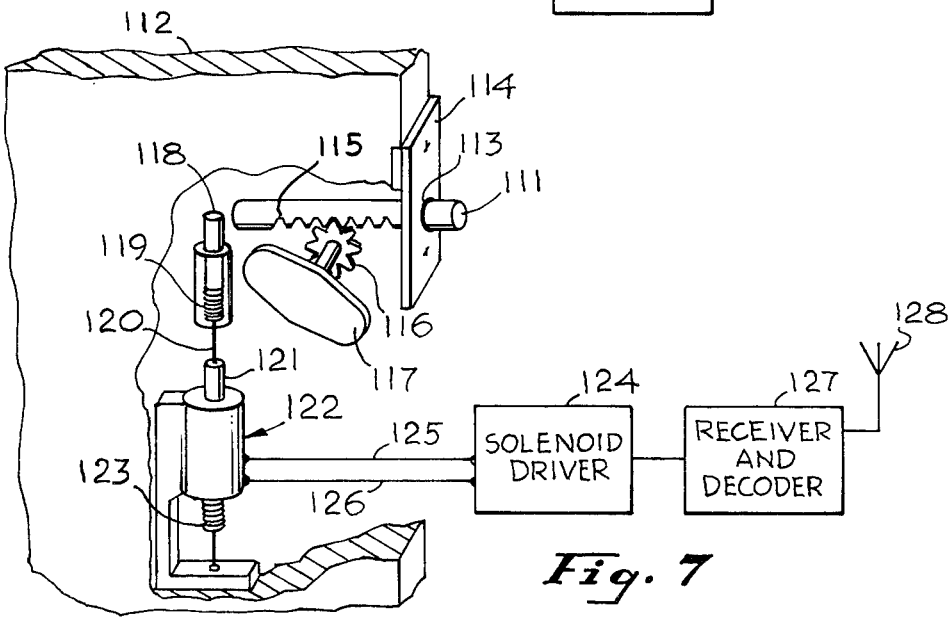
FIG. 7 is a view, partially in block form and partially in cut-away form, of the electromechanical enabling means of FIG. 1 applied to a different safety application.

FIG. 7 shows in schematic form an arrangement in accordance with the invention which is adapted to prevent release of a door lock unless controlled by an authorized operator. In FIG. 7, dead bolt 111 may be carried in door 112 for the purposes of securing door 112 when dead bolt 111 is extended through opening 113 in plate 114. Plate 114 is carried by an adjacent doorframe member, not shown. Dead bolt 111 may carry rack portion 115 with which rotatable gear member 116 cooperates so that upon rotation of knob 117 dead bolt 111 may be moved in or out of striking plate 114 unless stop member 118 is in its extended position as shown in FIG. 7. Stop member 118 is urged into its extended position by spring 119. Connecting member 120 joins stop member 118 and armature 121 of solenoid 122. Spring member 123 urges armature 121 in an upward direction, permitting stop member 118 to block inward motion of dead bolt 111.

Solenoid driver 124 is coupled to solenoid 122 through connectors 125 and 126. Solenoid driver 124 receives its control signal from receiver and decoder 127 when the signal received at antenna 128 has the predetermined distinctive characteristic designed into transmitting equipment carried by authorized personnel, for example by the wrist-carried transmitter 60 in FIG. 2. Upon the receipt of such a distinctive signal with predetermined characteristics at antenna 128, solenoid driver 124 energizes solenoid 122, causing armature 121 to be pulled in a downward direction in the illustration of FIG. 7 with the result that stop member 118 is also pulled downwardly. Knob 117 may then be turned freely, causing dead bolt 111 to be withdrawn through aperture or opening 113 in striking plate 114 so that door 112 may be opened. This entire electromechanical system for withdrawing stop 118 and enabling the operation of knob 117 and the associated mechanism may be battery operated and self-contained as was the electromechanical system in the firearm of FIG. 1.

While the description thus far has dealt primarily with use of radio waves for coupling an enabling transmitter in the possession of an authorized person to effect the enabling of the operation of a lock or other control member, it will be understood that other forms of control signals may be used. For example sonic or ultra-sonic, visible light, infra-red or ultra-violet radiant energy may be used to couple the enabling signal to the enabling portion of the system. The use of pattern recognition systems, such as voice recognition systems and other even more sophisticated devices such as brain wave recognition equipment, may be incorporated in the system where the installation merits such sophistication.

Figure 8:
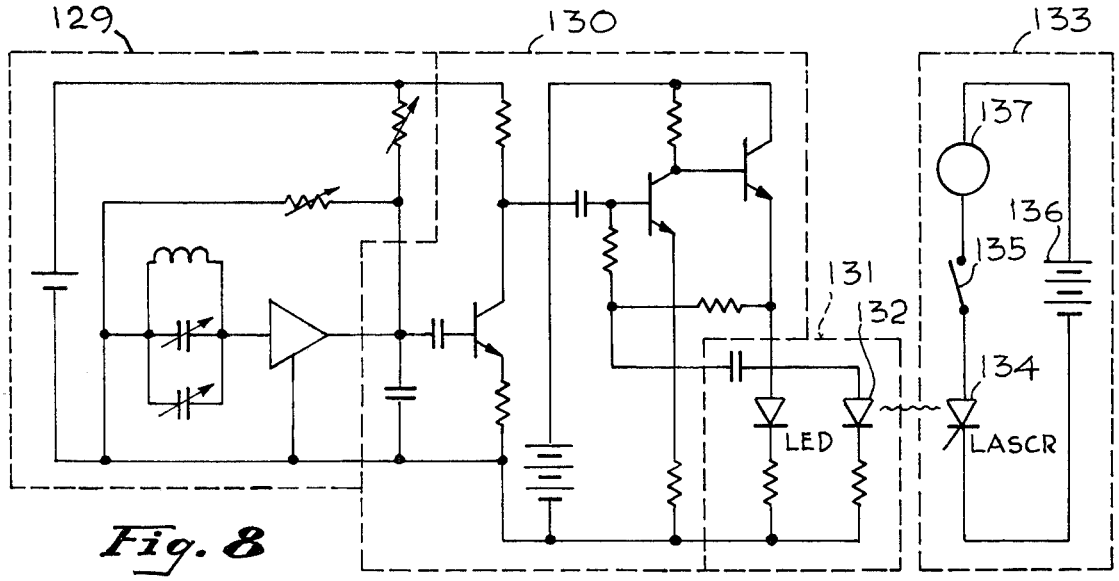
FIG. 8 is a schematic diagram of one form of the receiver, decoder and enabling section of the system of FIG. 6.

In FIG. 8 there is shown an additional form of receiver for use in the system. In this figure, demodulator section 129 is designed to detect the audio modulation of an input RF signal and to provide an audio output signal representing the modulation thereof. That audio signal is amplified in audio section 130 which drives two light emitting diodes in LED section 131. One of the light emitting diodes is used merely to indicate operation of the circuit while the other light emitting diode (LED) 132 is used to generate light for coupling to the solenoid driving section 133 which includes in its circuit a light activated silicon controlled rectifier (LASCR) 134 which is positioned to receive light emitted by diode 132 when a signal with the proper frequency and modulation is received, detected and amplified in sections 129 and 130 of the enabling receiver. When element 134 receives light from diode 132 the circuit through it is closed and, assuming manual switch 135 is closed, energy from battery 136 will actuate solenoid 137 and it, through a mechanical linkage, not shown, will enable the operation of an associated secured device. The use of the LED-LASCR combination results in two advantages. The first advantage is the isolation of the solenoid triggering circuit from random electrical noise which might exist in the electronic circuits as a result of spurious signals being received and detected in the receiver. The second advantage of the use of this combination is that it provides a high effective power gain. The circuit of FIG. 8 operates reliably with a 400 micro-volt signal applied to a 4 megohm impedance at its input terminals. That signal controls an instantaneous power of 7 watts in the solenoid unit 133 for a power gain of $175 \times 10^{12}$.

Figure 9:
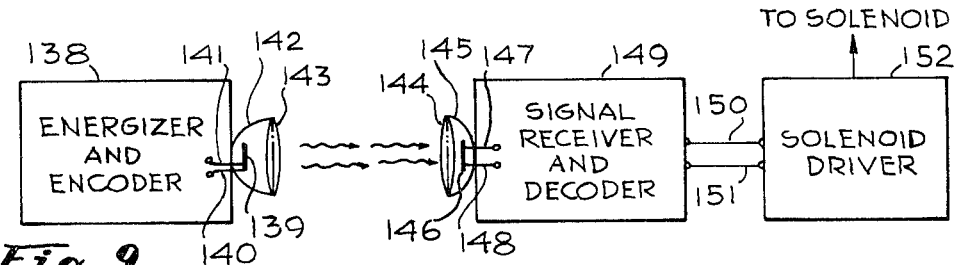
FIG. 9 is a block diagram of a safety system utilizing infra-red radiant signals in accordance with this invention.

In FIG. 9 there is shown a safety system (in simplified block form) which utilizes electromagnetic waves at infra-red frequencies to enable the operation of equipment by authorized personnel only. Energizer and encoder 138 generates pulsed DC signals, the number and duration of pulses being determined by the encoder portion of device 138 to provide a secured signal pattern when the energy from device 138 is applied to infra-red generating element 139 through conductors 140 and 141. Element 139 may be of gallium arsenide appropriately doped according to well-known semiconductor techniques so that, upon the application of direct current thereto, element 139 generates electromagnetic energy at a predetermined infra-red frequency. The energy from element 139 is concentrated in a forward direction by reflector 142 and by lens 143 which is chosen to have relatively high transparency to signals at infra-red frequencies.

Infra-red signals from source 139 pass through lens 144 and are concentrated by reflector 145 on transducer 146 which may be a silicon solar cell, such cells having a very high response in the infra-red spectrum. The electrical output signals from transducer 146 are taken through conductors 147 and 148 to the decoding section of receiver and decoder 149. If the infra-red signals received by transducer 146 have the distinctive characteristics which have been predetermined for an infra-red transmitter carried by an authorized person, an output signal appears at conductors 150 and 151. This output signal is used to activate solenoid driver 152 which is coupled to a solenoid in the fashion shown and described in connection with FIG. 1. The encoding of the signals from energizer and encoder 138 may take the form of pulse modulation of the infra-red signals with a predetermined combination of pulses representing the distinctive characteristics assigned to an authorized person for the security system.

Figure 10:
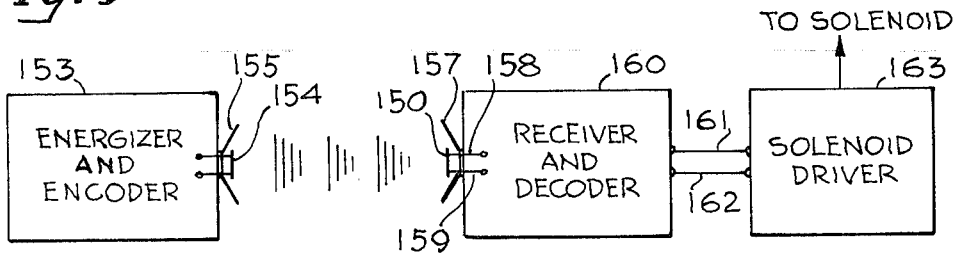
FIG. 10 is a block diagram of a safety system utilizing ultra-sonic signals in accordance with the present invention.

In FIG. 10 energizer and encoder 153 may operate at sonic or ultra-sonic frequencies. For ease of focusing it is preferred that the chosen frequency be very high, for example, in the MHz range. The signals generated by energizer and encoder 153 are fed to electro-acoustical transducer 154. Reflector 155 permits concentration of the ultra-sonic signal generated by transducer 154. That transducer may take the form of a magnetostrictive or piezo-electric device at ultra-sonic frequencies. If the system is operating at audible sound frequencies, conventional dynamic speakers may be used for element 154. Magnetostrictive and piezo-electric electro-acoustical transducers are well-known in the art and need not be described in detail here. The encoding of the ultra-sonic or sonic signals from element 153 can take many forms but pulse modulation is the most straightforward to achieve security.

The sound waves transmitted by transducer 154 are concentrated in acousti-electrical transducer 156 by reason of reflector 157 to produce an output signal at conductors 158 and 159. Those conductors are coupled to the demodulating and decoding circuits of receiver and decoder 160 and, if the incoming sonic signal has the predetermined distinctive characteristics of an authorized transmission, an output signal will appear at conductors 161 and 162 for coupling to the solenoid driver stage 163. Solenoid driver 163 provides an output signal or pulse to an enabling solenoid in the fashion described in connection with FIGS. 1 and 4. Acousti-electrical transducer 156 may be a piezo-electric element.

While the discussion thus far has dealt with the enabling of a mechanical device, such as a firearm, by properly authorized personnel, there are many situations in which the operation of an electrical device, such as a radio transmitter or a telephone, is involved. This could be true, for example, in the forestry service where transmitters are placed at strategic locations in the forest for use by forest rangers only. These transmitters communicate with central fire control headquarters through relay stations placed on promontories in the forest. Other applications could be police radio links from neighborhood boxes to a central location.

Figure 11:
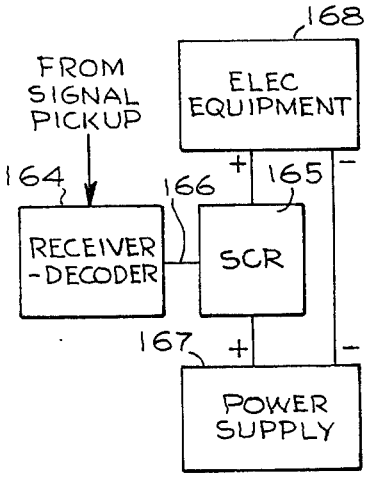
FIG. 11 is a block diagram of the receiving, decoding and enabling circuits for a safety system according to this invention applied to electrical equipment.

A simple block diagram of a possible configuration for such a system is shown in FIG. 11. In that figure a signal from signal radiating means carried by authorized personnel, whether that signal radiating means is in the radio, infra-red or other portion of the electromagnetic spectrum or whether the source ia an ultrasonic generator, carries distinctive modulating characteristics and those characteristics are detected in receiver and decoder 164 and applied to the triggering element of SCR 165 via conductor 166 to control application of power from power supply 167 to the transmitter or other electrical equipment 168. In the absence of a signal having the predetermined distinctive characteristics at the input to receiver and decoder 164, there is no output signal on conductur 166 and SCR 165 is non-conductive, thus disabling the operation of electrical equipment 168. However, upon receipt of a signal having the distinctive characteristics an output signal appears on conductor 166 and SCR 165 is triggered. The operation of a silicon controlled rectifier is well-known and described extensively in the art and need not be discussed here. Other means are available for triggering into conductivity an electrical circuit element which is normally non-conductive and interposed between a source of power and electrical equipment which it is desired be operated only by authorized personnel.

Figure 12:
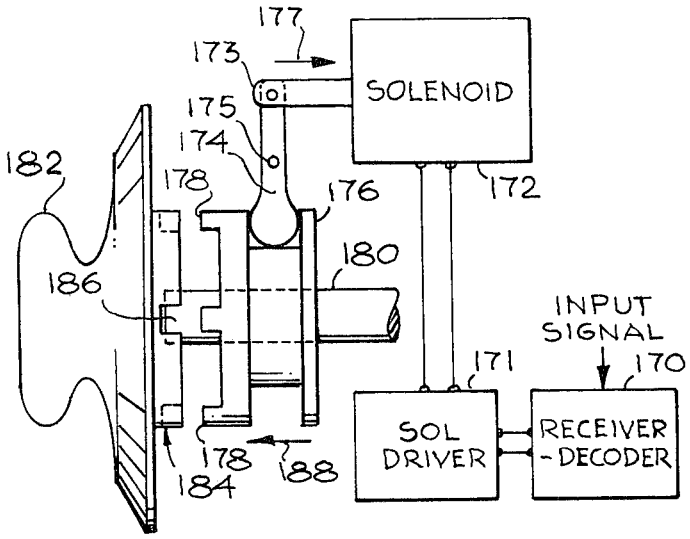
FIG. 12 is a combination block and schematic diagram showing a particular embodiment of the invention as applied to a locking mechanism.

In FIG. 12 an input signal from an acoustical or electromagnetic pickup device such as those shown in FIGS. 4, 6, 9 and 10, is received and decoded in receiver-decoder 170 and activates solenoid driver 171 when the proper coding is found to exist on the input signal. Solenoid 172 is then activated by driver 171 causing motion of arm 173 in the direction shown by arrow 177. Arm 173 is coupled through linkage 174, which pivots about pivot point 175, to sliding coupler 176 which carries protrusions 178 and is slidably mounted on spline 180. Spline 180 is caused to rotate with sliding coupler 176 and dial or knob 182 when the protrusions or cogs 178 engage slots or recesses 186. Collar 184 which is carried in fixed relationship by dial 182 has slots 186 therein spaced and sized to cooperate with protrusions 178 on sliding coupler 176. Spline 180 is coupled to the lock tumbler mechanism, not shown, and causes positioning of the tumblers in that mechanism when knob 182 is rotated, assuming protrusions 178 are engaging slots 186. That engagement occurs when sliding coupler 176 is moved in the direction of arrow 188 as a result of the pulling by solenoid 172 on arm 173 in the direction shown by arrow 177, arm 173 being coupled through linkage 174 to sliding coupler 176. Thus, the enabling of a mechanical coupling system is effected.

Alternatively, the system of FIG. 12 may be considered as operative to block any manipulation of the knob 182 until properly encoded signals are received by the receiver decoder 170 to cause the solenoid driver 171 to energize the solenoid 172. In such an arrangement, the slidable collar 176 would be considered a locking member for the knob 182 which in this case is attached to the shaft 180. The collar 176 would be fixed against rotation so that when the cogs 178 engage the recesses 184 in the knob 182, the knob 182 cannot be manipulated to rotate the spline or shaft 180 for the associated mechanism (not shown). In this instance, the solenoid 172 would be energized to drive the armature 173 in the direction opposite to the arrow 177 which would retract the collar 176 to the position shown in FIG. 12. The normal position of the collar 176 with the solenoid 172 de-energized would be to the left in the direction of the arrow 188 and in locking engagement with the knob 182.

Such a system may comprise a locking arrangement such as a combination lock for a safe (in which case the knob 182 is the selector dial), an actuating mechanism such as a common door latch (in which case the knob 182 may be the door knob), or any similar arrangement in which the operation of the mechanism is blocked or disabled until particular encoded control signals are received which result in removal of the disabling condition. Application of the system in FIG. 12 to an automobile or other vehicle for example, could involve disablement of the starter circuit or the ignition circuit or both by means of a suitable switch actuating arrangement or it could even be installed in the steering mechanism in a manner to prevent engagement of the steering wheel (the knob 182). Such a system might be installed in a railroad switching device with the knob 182 of FIG. 12 corresponding to the manual (or other) actuating control member and being disabled or blocked from actuating the switching device until the application of preselected control signals from a particularly encoded signal source presumably available only to authorized personnel. These examples showing uses of the invention are by way of illustration only and are not intended to limit the utilization of systems in accordance with the invention.

Figure 13:
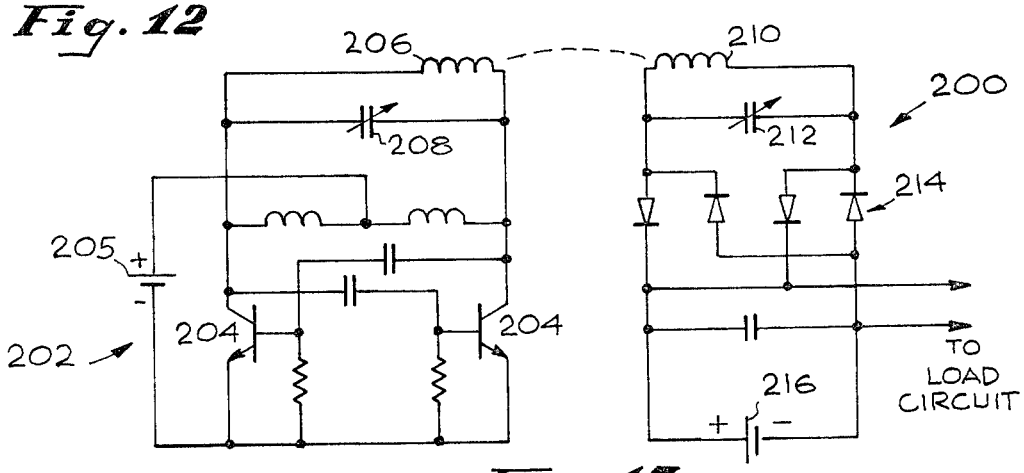
FIG. 13 is a schematic diagram of a battery charging circuit of particular utilization in certain embodiments of the invention.

In certain arrangements embodying the present invention, such as the firearm of FIG. 1, for example, it is extremely important that there be no failure of the protection system under any circumstances. Thus although steps can be taken to replace the battery in the self-contained power supply on a regular basis, it is desirable to insure that the power supply battery in the weapon is always in good condition, fully charged, and ready to use. One way of assuring this is accomplished through the use of the battery charging system providing power by radiation as shown in FIG. 13. In this system, it is contemplated that the receiver portion 200 is mounted within the weapon and the transmitter portion 202 is mounted in association with the holster so that, when the weapon is in proper position with the holster, the two units are juxtaposed so as to transfer power as indicated to the receiver portion 200 for charging the battery in the weapon power supply.

As shown in FIG. 13, the transmitter portion 202 comprises a pair of transistors 204 intercoupled with associated circuitry to operate as an RF multivibrator powered by a battery 205. The frequency of the multivibrator is determined by the resonant circuit comprising the inductor 206 and capacitor 208 and the saturation time of transistors 204. The inductor 206 is inductively coupled to a corresponding resonant circuit in the receiver 200 when the section 200 and 202 are maintained in close proximity, as when the firearm is in its holster, the inductor 206 acting as the primary side of an RF transformer.

The receiver section 200 comprises an inductor 210 acting as the secondary of an RF transformer in a resonant circuit with the capacitor 212. A series of diodes 214 are coupled in a bridge network to the output of inductor-capacitor circuit 210-212 to provide DC power to charge the battery 216.

In the arrangement shown in FIG. 13, very little current is drawn by the circuit of the transmitter section 202 until the inductor 210 is brought into close proximity with the inductor 206, at which time power is transferred to the resonant circuit 210-212 of the receiver section 202. In one particular embodiment of the FIG. 13 circuitry, the combined circuit voltage of inductor 210 was adjusted to equal 1.3 times the voltage of battery 216 plus .8 volts. This adjustment is effected by the choice of turns ratio of the inductors 210, 206. With such an arrangement in a system in accordance with the present invention, such as the firearm of FIG. 1, the user can be assured that the system controlling the weapon is at all times operative and ready for use insofar as its reliance on its self-contained power supply is concerned. The components making up the receiver and charging circuit 200 are extremely small and light in weight so that the weight and balance of the weapon are not noticeable affected. Moreover, a smaller battery 216 can be employed where charging in this fashion is provided, with the large battery 205 being provided in the transmitter section 202 for mounting on the holster or belt in which the weapon of FIG. 1 is customarily carried. Arrangements such as are shown in FIG. 13 may also be employed wherever it is important to provide for charging of the power supply within the device to be controlled without actual connection thereto from outside the unit.

Thus, although there have been described hereinbefore specific arrangements of a safety system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention.

What is claimed is:

1. In a hand-held firearm for operation only by authorized personnel, the combination comprising:
   - a firing mechanism;
   - first means positioned on said firearm and normally locking said mechanism in an inoperative position; and
   - second means adapted to be carried by said authorized personnel and including means for transmitting a radiated energy control signal to which said first means is responsive only at the option of said authorized personnel to deactivate said first means and restore the operability of said firing mechanism.

2. Apparatus according to claim 1 in which said first means includes means responsive to finger pressure applied to the firearm in an effort to operate the firing mechanism thereof to deactivate said first means.

3. Apparatus according to claim 1 in which said second means includes means for generating and radiating a distinctive electromagnetic wave signal, and said first means includes means responsive only to the reception of said distinctive electromagnetic wave signal from said second means to render said firing mechanism operative.

4. Apparatus according to claim 3 in which said second means is normally operating to radiate said distinctive signal when said firearm is being carried by said authorized personnel, and said first means is normally in the locking position thereof and includes means for shifting said first means to an unlocking position instantly in response to an attempt by said authorized personnel to operate said firing mechanism.

5. A firearm incapable of being fired except by an authorized person, said firearm having a trigger-operated firing mechanism, comprising:

means normally locking said firing mechanism against operation; and electromagnetic means for disabling said locking means in response to the reception of a distinctive signal emanating from a source exterior to said firearm; for use with signal source means adapted to be carried on said authorized person and normally operating to radiate said distinctive signal and including means on said firearm operable at the option of said authorized person to render ineffective said locking means if said firearm is being held for firing by said authorized person.

6. In combination with a firearm having a trigger adapted to operate a firing mechanism embraced by a handgrip designed to be grasped by an authorized user's hand preparatory to operating said firing mechanism, a safety device for said firearm comprising first and second structurally independent assemblies, said first assembly being carried by said authorized user and radiating an electromagnetic signal of a distinctive character, said second assembly being incorporated in said firearm and including means normally disabling said firing mechanism, and means responsive to reception of a signal from said first assembly to restore the operability of said firing mechanism.

7. The combination defined in claim 6 in which said second assembly is normally energized and in instant readiness to restore the operability of said firing mechanism automatically upon the application of slight operating pressure to said trigger.

8. The combination defined in claim 6 in which said second assembly includes antenna means positioned and effective to receive a signal being radiated from said first assembly only when the user's hand is grasping the handgrip, and means operable in response to slight operating pressure applied to the trigger in said firing mechanism to restore the operability of said firing mechanism.

9. The combination defined in claim 6 in which said second assembly includes self-contained radiant-energy receiving means housed within said firearm, said receiving means including antenna means positioned in closely coupled relation to the hand of a person grasping said handgrip in a customary manner, said receiving means being effective when said handgrip is so held to receive the signal being transmitted thereto from said first assembly via the hand grasping said handgrip.

10. The combination defined in claim 9 characterized by the fact that said firing mechanism remains disabled despite said handgrip being firmly grasped in said user's hand, said firearm including means operable by the user to activate said second means to receive a signal from said first means and to be responsive thereto to restore the operability of said firing mechanism.

11. The combination defined in claim 10 wherein said second assembly includes circuit control means operable upon initial movement of said trigger to restore the operability of said firing mechanism, whereby said trigger is effective, upon further movement thereof, to operate said firing mechanism through a normal operating cycle.

12. The combination of claim 6 wherein the first assembly includes high frequency radiant control signal generating means utilizing the user's body to radiate said control signal.

13. The combination of claim 8 in which said handgrip includes a removable cover plate, and including means on the interior side of said cover plate supporting said antenna means.

14. The combination of claim 6 further including indicator means for indicating whether said first and second independent assemblies are functioning properly when the user grasps said handgrip.

15. Apparatus according to claim 14 in which said indicator means is normally deactivated and is activated automatically when an authorized user grasps said handgrip.

16. In combination with a safety firearm incapable of use unless enabled by a preselected distinctive radiated energy control signal received from a source on an authorized person carrying said firearm, said firearm having a trigger adapted to control a firing mechanism;

battery-energized signal receiving and processing means carried by said firearm and having an output circuit thereof coupled to means normally effective to disable said firing mechanism;

said trigger being coupled to said output circuit and being effective when said trigger is initially moved to modify conditions in said output circuit and thereby restore the operability of said firing mechanism.

17. The combination of claim 16 further including time delay means operable to return said firing mechanism to the disabled state thereof automatically in a predetermined time interval following operation of said trigger.

18. The combination of claim 16 further including first means adapted to be carried by said authorized person for transmitting said distinctive control signal to the receiving and processing means and second means adapted to be juxtaposed adjacent said firearm for transmitting power to charge the battery of said battery-energized signal receiving and processing means.

19. The combination of claim 16 wherein the output circuit further includes electromagnetic means normally locking said firing mechanism against operation but permitting slight initial movement of said trigger, and means for energizing the electromagnetic means upon initial movement of said trigger.

20. The combination of claim 19 wherein the output circuit further includes means for normally limiting current flow therein to a fraction of the flow occurring therein when said electromagnetic means is energized.

21. The combination of claim 19 wherein said output circuit includes means for storing energy which is adequate when released to energize said electromagnetic means and to restore the operability of said firing mechanism, and means operatively associated with said electromagnetic means for slowing the return thereof to its position of locking said firing mechanism.

22. The combination of claim 21 in which said means for slowing the return of said electro-magnetic means to a locking position includes dashpot means.

23. The method of controlling the operation of a firearm firing mechanism to prevent operation thereof by unauthorized personnel which comprises the steps of:

providing the firing mechanism with deactivatable locking means which normally prevent operation of the firing mechanism;

generating a distinctive high frequency electromagnetic-wave signal;

coupling said signal to the body of a person authorized to use the firearm;

equipping the firearm with radio receiver means designed to receive said high frequency signal when said authorized person is grasping said firearm to fire the same; and utilizing the output signal of said radio receiver means when said firearm is grasped in the hand of said authorized person to deactivate said locking means and restore the operability of said firing mechanism.

* * * * *